US008192179B2

(12) United States Patent
Miller et al.

(10) Patent No.: US 8,192,179 B2
(45) Date of Patent: Jun. 5, 2012

(54) METHOD AND APPARATUS FOR ISOLATING A MOTOR OF A BOX FAN

(75) Inventors: Robert H. Miller, Chicago, IL (US); Manuel M. Almanza, LaGrange Park, IL (US); Michael R. Jaron, Chicago, IL (US)

(73) Assignee: Sunbeam Products, Inc., Boca Raton, FL (US)

( * ) Notice: Subject to any disclaimer, the term of this patent is extended or adjusted under 35 U.S.C. 154(b) by 818 days.

(21) Appl. No.: 12/258,287

(22) Filed: Oct. 24, 2008
(Under 37 CFR 1.47)

(65) Prior Publication Data

US 2009/0269186 A1 Oct. 29, 2009

Related U.S. Application Data

(60) Provisional application No. 60/982,342, filed on Oct. 24, 2007.

(51) Int. Cl.

| | |
|---|---|
| ***F04B 53/20*** | (2006.01) |
| ***F04B 49/10*** | (2006.01) |
| ***F04B 39/12*** | (2006.01) |
| ***F04D 29/64*** | (2006.01) |
| ***F04D 29/02*** | (2006.01) |

(52) U.S. Cl. ..... 417/423.14; 417/423.9; 415/121.2

(58) Field of Classification Search ..... 417/423.14
See application file for complete search history.

(56) References Cited

U.S. PATENT DOCUMENTS

| | | | | |
|---|---|---|---|---|
| 5,460,485 | A * | 10/1995 | Sugiyama et al. | 415/208.2 |
| 6,015,265 | A * | 1/2000 | Lasko et al. | 416/247 R |
| 6,309,192 | B1 * | 10/2001 | Litvin | 417/423.14 |
| 6,364,618 | B1 * | 4/2002 | Moreno | 416/247 R |
| 6,439,862 | B2 * | 8/2002 | Chen | 417/423.7 |
| 6,695,577 | B1 * | 2/2004 | Susek | 415/121.2 |
| 6,926,497 | B2 * | 8/2005 | Lin et al. | 415/213.1 |
| 7,301,253 | B2 * | 11/2007 | Tang et al. | 310/91 |
| 7,419,368 | B2 * | 9/2008 | Milks | 417/423.7 |
| 2005/0271527 | A1 * | 12/2005 | Chen et al. | 417/423.3 |

* cited by examiner

*Primary Examiner* — Victor A Mandala
*Assistant Examiner* — Joseph Schoenholtz
(74) *Attorney, Agent, or Firm* — Seth M. Blum

(57) ABSTRACT

A fan having a housing and a motor connected to the housing via a nonconductive support member. In one form, the nonconductive support member takes the form of a grill. The motor may be connected to the grill such that separate brackets to support the motor are not needed and the motor is electrically isolated from the fan housing. Insulating members may be used to connect the motor to the nonconductive support member. Additional fasteners may be used to connect the motor to the support member. A generally rectangular box fan assembly includes a metal fan housing having a peripheral shroud portion, a nonconductive grill connected to the shroud portion, and a motor assembly connected to the nonconductive grill such that the motor assembly is electrically isolated from the metal fan housing. A method for insulating a box fan from a motor including providing a motor, a metal box fan housing and a nonconductive support member connected to the fan housing and electrically isolating the fan housing from the motor by attaching the motor to the nonconductive support member with a fastening member.

12 Claims, 16 Drawing Sheets

METHOD AND APPARATUS FOR ISOLATING A MOTOR OF A BOX FAN

CROSS-REFERENCE TO RELATED APPLICATIONS

This application claims the benefit of U.S. Provisional Application No. 60/982,342, filed Oct. 24, 2007, which is hereby incorporated by reference herein in its entirety.

FIELD OF THE INVENTION

This invention relates generally to electric insulation components for electric fans and motor assemblies and more particularly concerns improvements in the design and manufacturability of box-type electric fans.

BACKGROUND OF THE INVENTION

Electric fans of all types have traditionally been an effective way to provide climate control within a living space. During the summer months, electric fans provide a very low cost solution to keep air circulating within a living space, and hence, help keep temperatures from reaching uncomfortable, and sometimes dangerous, levels. In recent years, electric fans have been made increasingly efficient and more powerful through advancements in electric motor technology. Many electric fans today, such as box fans, incorporate four pole and six pole split capacitor motor technology. While this technology increases efficiency and power, it does require relatively higher operating voltages.

While existing electric fan assemblies have all been designed to be safe for their intended use, it is desirable to not only meet, but exceed safety standards set by various organizations, including independent organizations such as Underwriters Laboratories (UL). With this goal in mind, it is desirable to electrically isolate electric motors from other portions of the fan assembly. This is especially true when the fan is being operated in very humid conditions or when the air being moved by the fan has high moisture content. Condensation caused by the air can create a current leakage pathway between the fan motor and other parts of the fan, such as a metallic shroud of a typical box-type fan. In such cases, these other parts of the fan can become electrically charged. Electrical isolation of the fan motor prevents such occurrences.

Naturally, isolation of electrical components is well known. However, presently-known attempts at electrical isolation have many drawbacks. For example, one known insulated box fan employs a plastic isolator ring that is attached to the fan housing at a first set of points and separately attached to the fan motor at a second set of points. The attachments are implemented with screws. One problem associated with this fan is the difficulty in alignment of the attachment points between the isolator ring and the motor. This difficulty is created by the ring being a single component having multiple attachment points. Because all of the attachment points are fixed to a single component, alignment of the attachment points are linked together, thereby creating alignment and tolerance constraints. This creates manufacturing quality concerns. Furthermore, because the isolator ring is a single component, it is more susceptible to manufacturing defects caused by inconsistencies between each of the attachment points, dimensional or otherwise. Another problem is the cost of the components and the assembly. Because of the multiple attachment points, the number of screws needed for the attachment points, the size of the isolator ring, and other factors, the assembly is relatively costly.

In another box fan known in the art, plastic insulating grommets or sleeves are used to electrically isolate a fan motor from the metal housing. The insulating sleeves are mounted in recesses in the motor casing and are configured to receive fasteners which connect the motor to metal motor mounting brackets connected to the metal housing. The insulating sleeves are also effective to electrically isolate the fasteners from the metal brackets.

It is also known in the art to use insulating grommet sleeves to electrically isolate metal motor support brackets from a fan housing. However, this is less desirable because it does not electrically isolate the motor from the metal motor support brackets themselves. Thus, a user could receive an electrical shock by touching the metal motor support brackets should a current leakage situation occur between the motor and the metal support brackets, even though the fan housing is electrically isolated from the motor.

It has been found that new insulating solutions can be more effective to reduce weight, cost, ease of manufacturing, and assembly time than previously known solutions to electrically isolate a motor from a fan housing.

SUMMARY OF THE INVENTION

The present invention generally provides electrical insulation arrangements for electric fans and motor assemblies.

According to one aspect of the present invention, an electric fan having a motor supported by an insulating support member is provided. Specifically, an electric fan motor is disposed within the frame and may be supported a number of different ways which electrically insulate or isolate the motor from the frame and other portions of the fan assembly. The fan motor is supported within the frame by a support member. In one embodiment, the motor support member may take the form of at least one support bracket or load bearing frame that is connected to the frame. Preferably, the support member is made of a nonconductive material, such as a polymer.

In another embodiment, the support member may take the form of a fan grill, such that the fan motor is directly supported by the fan grill. The fan grill is in turn connected to the frame. The fan grill has a mounting portion for mating with a mounting portion of the electric fan motor. The mounting portion of the fan motor may be connected to the mounting portion of the fan grill with fastening members. In a preferred form, at least one insulating member is mounted in the mounting portion of the fan motor, and the fastening member extends through the mounting portion of the fan grill and operably connects to the insulating member. In this way, the fastener is insulated from the motor, and therefore may be made of a conductive material without allowing current leakage or raising risk of shock. Alternatively, the fastening member may be made of an insulating material, and the insulating member may be omitted. In this form, the support bracket or brackets may be omitted entirely, thereby reducing material, simplifying assembly, and reducing production costs.

In another form, the support member may take the form of a fan grill with a reinforced portion to provide the necessary stability to mount the fan motor directly to the fan grill. In addition to providing extra stability, the grill must be designed to provide optimal air flow, while preventing access into the interior space of the fan to protect the user. The grill preferably has vertical and horizontal reinforced portions extending across the fan grill. The reinforced portions may take the form of integral brackets extending across the fan grill. The grill with reinforced portions may be used in tandem with or in place of separate support brackets.

In another form, the fan grill may have a recessed portion forming a handle, such that the fan assembly may be gripped by the user in the recessed portion. The recessed handle may be implemented alone to allow for a simpler and more cost effective design, or in combination with a separate handle to offer the user a plurality of positions at which the fan assembly may be gripped and transported. The recessed handle is preferably located on the rear fan grill portion adjacent the frame.

According to another aspect of the present invention, an electric motor for an electric fan having a fan housing is provided. The motor comprises a motor casing having an insulator mounting arrangement configured for mounting the motor to the fan housing. The mounting arrangement comprises a mounting portion of the motor casing, and an insulating member mounted to the mounting portion of the motor casing without a separate fastener. The insulating member is configured to accept a fastener that can be utilized to mount the motor casing to the fan housing such that the motor casing and the fan housing are insulated from each other.

According to another aspect, an insulated mounting arrangement for mounting an electric motor to a fan housing of an electric fan is provided. The arrangement comprises a mounting portion of the motor casing, an insulating member mounted to the mounting portion of the motor casing without a separate fastener, and a fastener disposed through a portion of the fan housing and within the insulating member such that the fastener is insulated from the motor casing.

According to another aspect, an electric motor for an electric fan having a fan housing is provided. The motor comprises a motor casing having an insulator mounting arrangement configured for mounting the motor to the fan housing. The mounting arrangement comprises a mounting portion of the motor casing, and an insulating member mounted to the mounting portion of the motor casing without a separate fastener to define a general point of attachment. The insulating member is configured to accept a fastener that can be utilized to mount the motor casing to the fan housing at the general point of attachment such that the fastener would be insulated from the motor casing.

According to yet another aspect, an insulated mounting arrangement for mounting an electric motor to a fan housing of an electric fan is generally provided. In one embodiment, the arrangement includes a mounting portion of a motor casing of the motor having a mounting aperture therein, an insulating member having at least a portion disposed within the mounting aperture of the motor casing, and a screw disposed through a portion of the fan housing and within the insulating member such that the screw is insulated from the motor casing.

According to another aspect, the insulating member includes a base portion and a protrusion extending therefrom, the protrusion being mounted to the mounting portion of the motor casing. In a particular embodiment, the protrusion is press-fit into a mounting aperture within the mounting portion of the motor casing.

According to yet another aspect, an insulated mounting arrangement for mounting an electric motor to a fan housing of an electric fan is provided where the arrangement includes a mounting portion of a motor casing of the motor, an insulating member connected to the mounting portion of the motor casing, and a motor mount portion of the fan housing. The insulating member is configured to directly engage the motor mount portion of the fan housing without separate fasteners. The engagement electrically insulates the fan housing from the motor casing.

According to yet another aspect, an electric fan is provided comprising a fan housing having a peripheral shroud portion and a front and a rear grill portion each disposed adjacent the shroud portion. The shroud portion and the grill portions define an interior region of the fan housing within which a motorized blade assembly is mounted to a motor mount portion of the fan housing such that the motorized blade assembly is electrically insulated from the fan housing. The motorized blade assembly includes a motor having a motor casing. The motor casing includes a vented rear surface disposed adjacent to the rear grill portion. The rear grill portion includes a first mesh portion and a second mesh portion defined by a plurality of openings within the rear grill portion. The second mesh portion is disposed adjacent to the vented rear surface of the motor casing. The openings of the second mesh portion are dimensioned such that a user's finger cannot pass therethrough and contact the motor casing while allowing sufficient air flow to cool the motor.

According to yet another aspect, an insulated mounting arrangement for mounting an electric motor to a fan housing of an electric fan is provided. The arrangement comprises a mounting portion of a motor casing of the electric motor, an insulating member mounted to the fan housing, and a fastener disposed through the insulating member and within the mounting portion of the motor casing such that the fan housing is insulated from the motor casing and the fastener.

These and other aspects of the invention will become apparent from a review of the Drawings, the Detailed Description, and the Claims.

DETAILED DESCRIPTION OF THE PREFERRED EMBODIMENTS

While the present invention will be described fully hereinafter with reference to the accompanying drawings, in which one or more particular embodiments is shown, it is to be understood at the outset that persons skilled in the art may modify the embodiments herein described while still achieving the desired result of this invention. Accordingly, the description which follows is to be understood as an informative disclosure of one or more specific embodiments in accordance with the general principles of the invention directed to the understanding by persons skilled in the appropriate arts of those principles, and not as limitations of the present invention.

Figure 1:
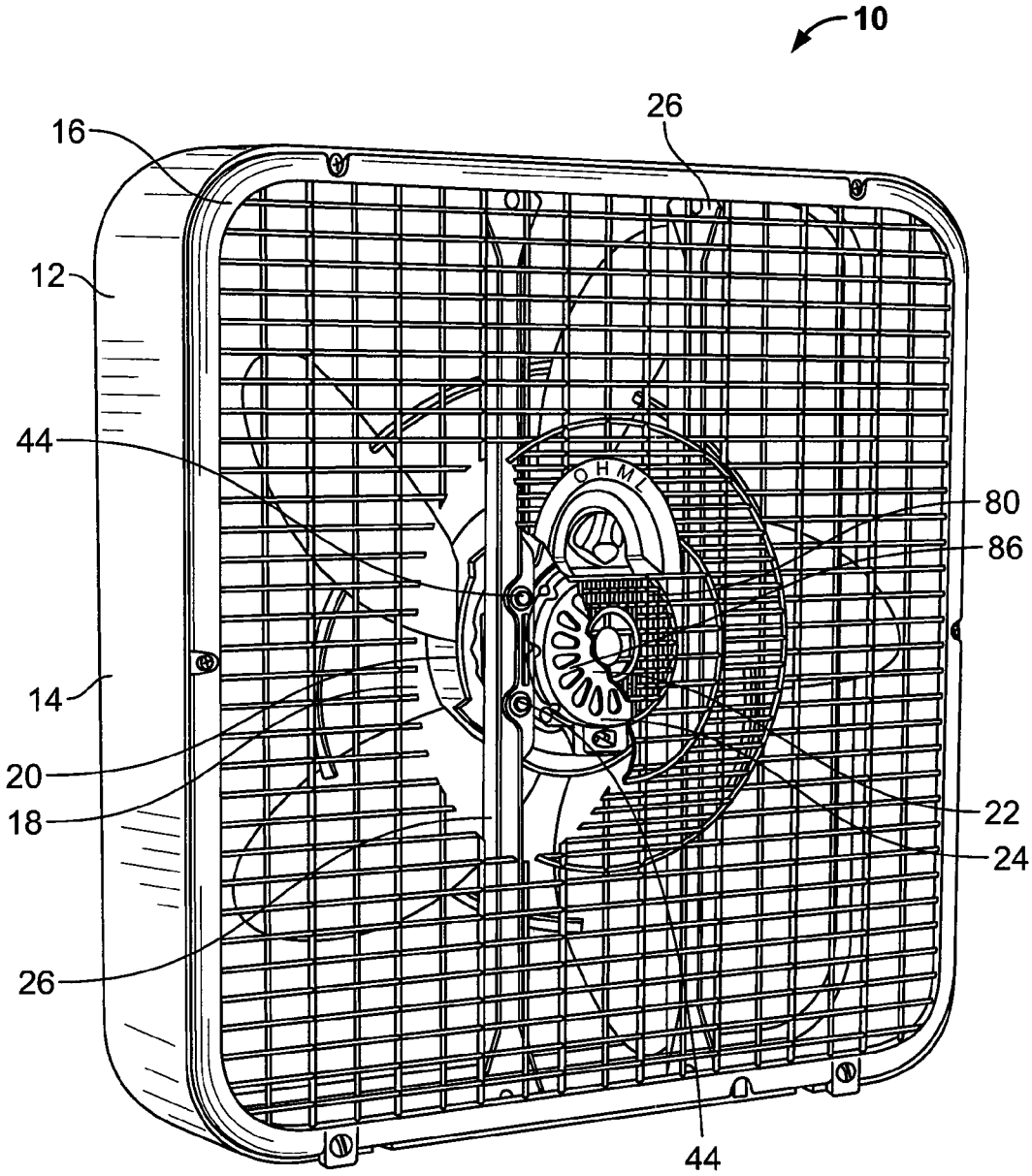
FIG. 1 is a perspective view of a fan assembly having a portion of a rear fan grill cut away to show an insulator mounting arrangement of an electric motor of the fan assembly in accordance with the principles of the present invention.

Referring to FIG. 1, an embodiment incorporating the principles of the present invention is shown as an electric fan assembly 10. The fan assembly 10 includes a fan housing 12 having a peripheral shroud portion 14 and two grill portions, a rear grill portion 16 and a front grill portion (not shown). In a particular embodiment suited for application of the principles of the present invention, the fan housing 12 is made of a metallic material and the grill portions are made of a molded plastic material. Each of the grill portions are disposed adjacent the shroud portion 14. The shroud portion 14 together with the grill portions define an interior region 18 of the fan housing 12 within which a motorized blade assembly 20 is disposed.

The motorized blade assembly 20 includes a motor 22 having a motor casing 24. In a preferred embodiment, the motor casing 24 is made of a cast metal. As shown in the cut away portion of FIG. 1, the motor 22 is mounted to a motor mount portion of the fan housing 12. In a preferred embodiment, the motor 22 is mounted to a pair of nonconductive mounting brackets 26 as shown in FIG. 1.

Figure 2:
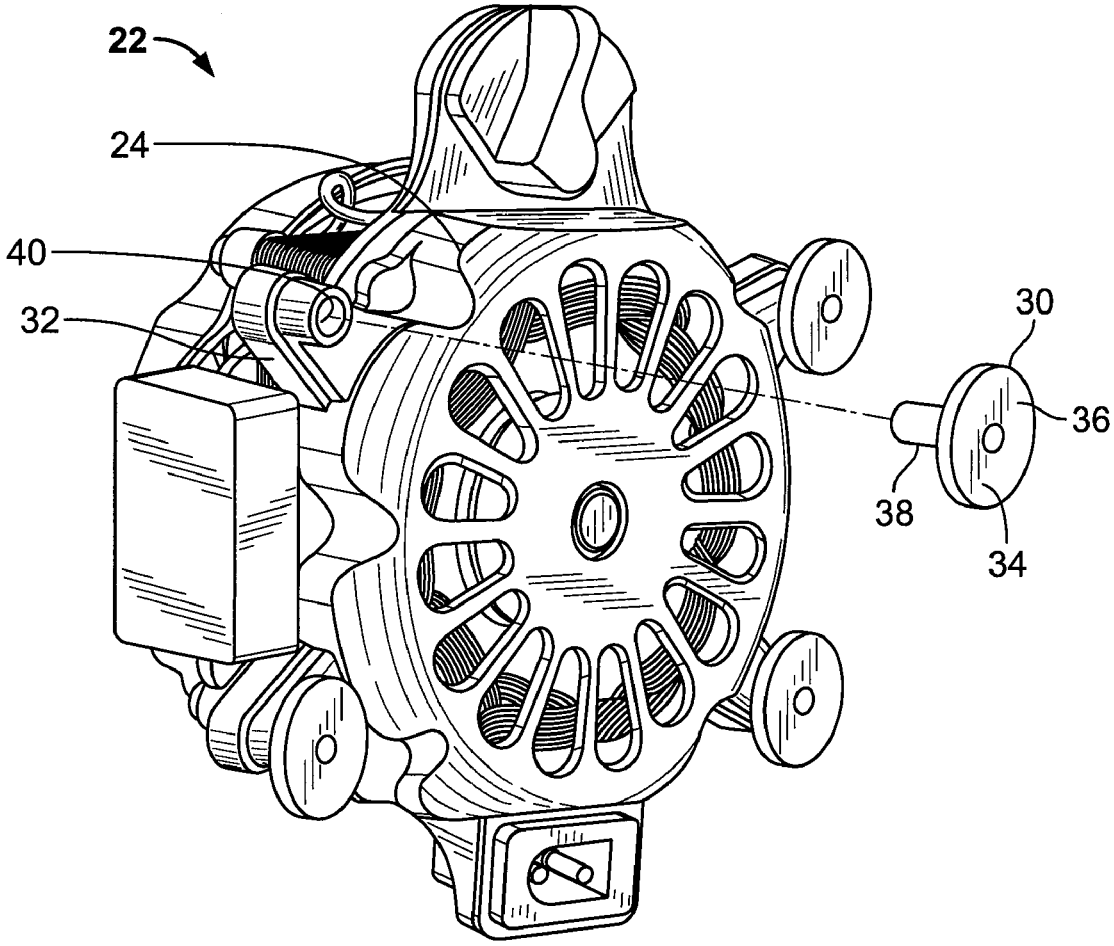
FIG. 2 is a perspective view of a motor showing a plurality of insulating members mounted thereto as known in the art, one of the insulating members being shown in exploded view.
Figure 3:
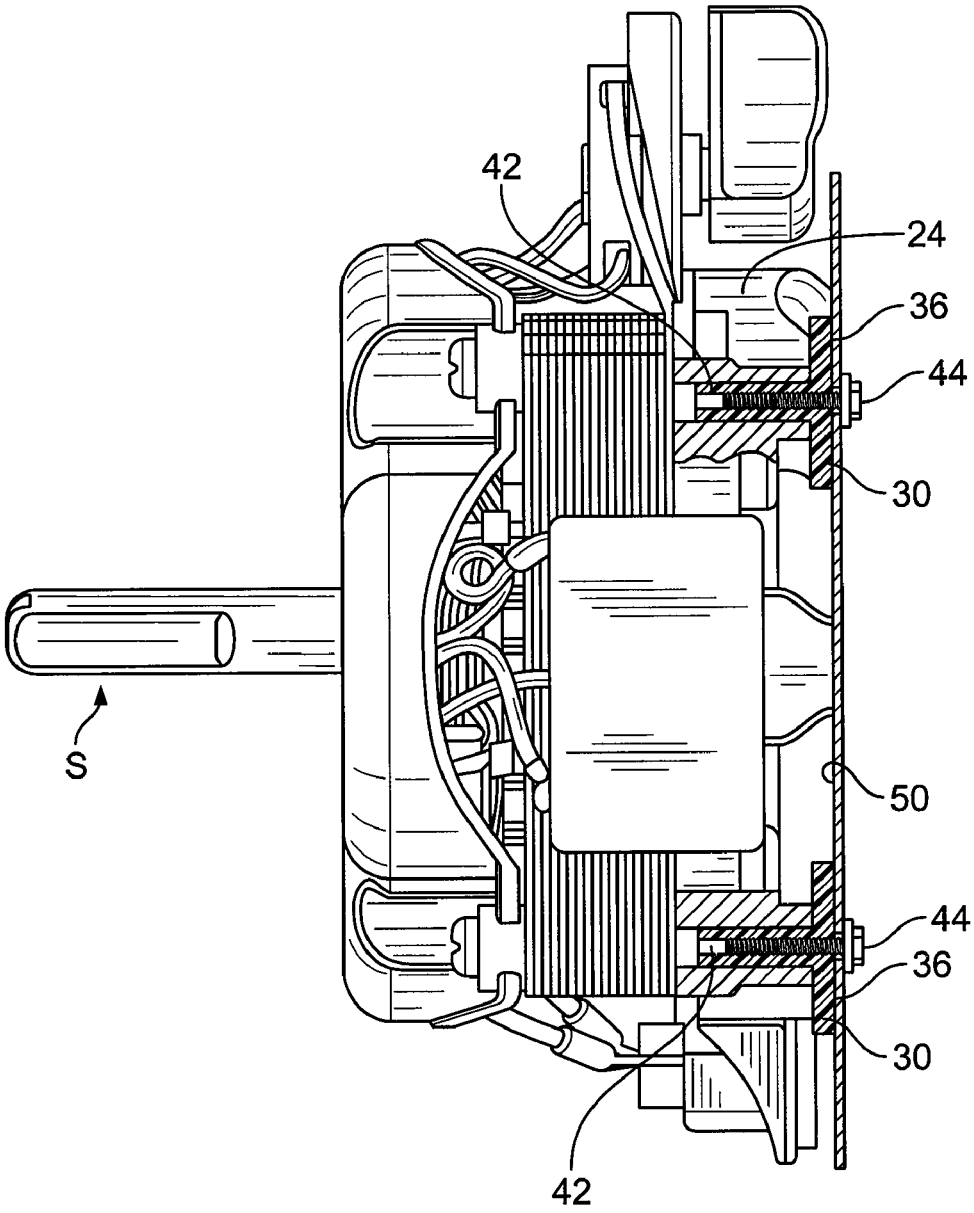
FIG. 3 is an elevational view of the motor of FIG. 2 mounted to a portion of a fan housing with screws, two of the mounting areas being shown in cross-section.
Figure 4:
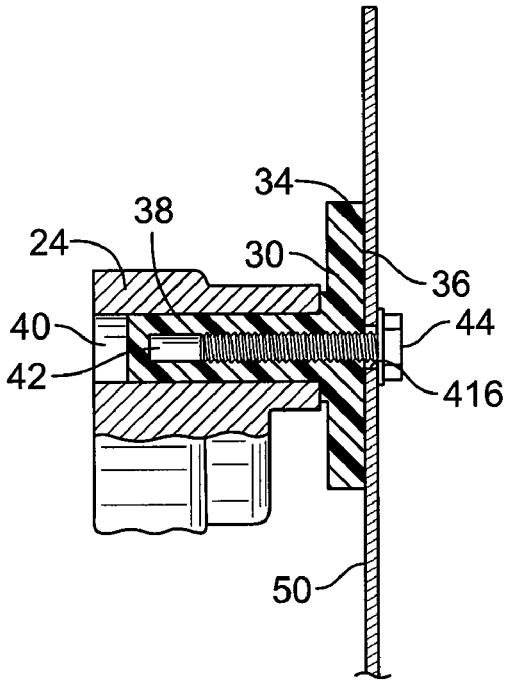
FIG. 4 is a detailed view of one of the mounting areas shown in FIG. 3.

In accordance with the principles of the present invention, the motor 22 is mounted to the fan housing 12 in an insulated mounting arrangement. Referring to FIGS. 2-4, the arrangement includes at least one insulating member 30 connected to a mounting portion 32 of the motor casing 24. Although the mounting portion 32 is shown in this embodiment as a portion outwardly and radially extending from the motor casing 32, the mounting portion can be in any form, and integrated with, or separately attached to, the motor casing 24, as long as the mounting portion 32 facilitates attachment of the insulating member 30, either directly or indirectly, to the motor casing 24. In a preferred embodiment, there are four insulating members 30 disposed about the motor casing 24 of the motor 22.

The insulating member 30 preferably includes a base portion 34 having a mounting surface 36 and a protrusion 38 extending therefrom. The protrusion 38 of the insulating member 30 is configured to be securely disposed within a mounting aperture 40 of the motor casing 24, thereby defining a general point of attachment to the motor casing 24. Preferably, the protrusion 38 has an interference fit with the mounting aperture 40 and is pressed therein by suitable manufacturing methods. However, the protrusion 38 can be securely disposed within the mounting aperture by any number of means, including by means of adhesive, insertion during casting or molding, snap fitting or other mechanical fastening arrangement, weldment, etc. According to a particular aspect of the invention, it is preferable that the mounting be facilitated without the use of a separate fastener.

As an alternate embodiment, an insulator member can be completely integrated within the motor casing, such as by insertion during casting, wherein the whole insulator member—in lieu of a protrusion, such as the protrusion 38—could define a general point of attachment. In yet another embodiment, a protrusion of the insulator member can be mounted in a radial direction with respect to the motor casing (i.e., generally transverse to an axis defined by a motor shaft S), in lieu of an axial direction as shown in FIGS. 2 and 3. In such an embodiment, the general point of attachment would be generally transverse to a direction of the mounting of the motor casing to the fan housing (i.e., the axial direction). In such a case, the mounting of the motor casing to the fan housing is still considered as being at the general point of attachment, since the mounting is generally positioned within, or adjacent to, a plane in the radial direction extending through the point of attachment and the axis of the motor shaft S.

If desired, the motor 22 can be supplied as a unit that includes the insulating members 30 secured thereto and ready for assembly to the fan housing 12.

According to a particular aspect of the invention, the general point of attachment can serve as a mounting area for mounting the motor casing to the fan housing. This is particularly facilitated in embodiments where the insulator member is mounted to the motor casing without the use of separate fasteners at the general point of attachment, which could otherwise interfere with the mounting of the motor casing to the fan housing. In the embodiment shown in FIGS. 1-4, the protrusion 38 of the insulating member 30 includes a blind hole 42 configured to accept a screw or fastener 44 (best shown in FIGS. 3 and 4). Preferably, the fastener is a self-tapping or thread-forming screw. As shown in FIGS. 3 and 4, the mounting surface 36 of the base portion 34 of the insulating member 30 is arranged to oppose a mounting surface 50 of the fan housing 12 when the motor 22 is mounted to the fan housing 12 by the fastener 44. The fastener 44 passes through the mounting surface 50 of the fan housing 12 and penetrates the base portion 34 and the protrusion 38 of the insulating member 30. As best shown in FIG. 4, the fastener 44 is insulated from the motor casing 24 when the motor is mounted to the fan housing 12. The insulating member 30 acts as an electrically insulating barrier between the fastener 44 and the motor casing 24 as well as between the motor casing 24 and the fan housing 12. Thus, in the case of a current leakage from the motor 22 that charges the motor casing 24, the current cannot establish a path to the fan housing 12. The mounting surface 36 of the base portion 34 is preferably designed to be large enough to prevent moisture from completely tracking across the mounting surface 36 and grounding the motor casing 24 to the fan housing 12.

Figure 5:
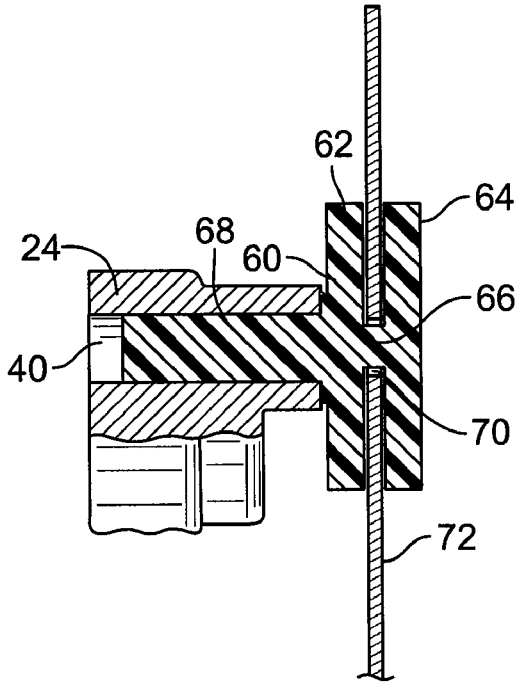
FIG. 5 is a partial cross-sectional view of a mounting area having an alternative mounting arrangement utilizing an alternative embodiment of an insulating member.
Figure 6:
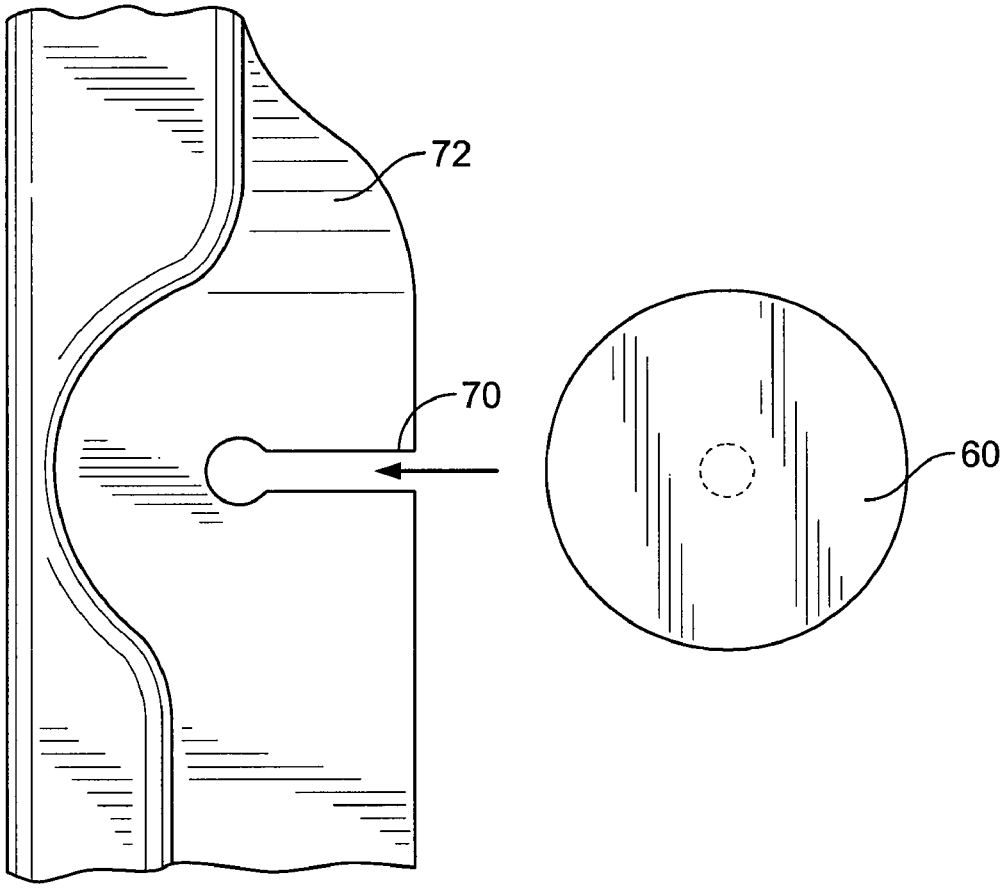
FIG. 6 is an assembly view of a motor mount portion of a fan housing and the alternative insulating member shown in FIG. 5, the motor mount portion including a slot that is configured to cooperate with the insulating member to mount the motor to the fan housing.

According to another aspect of the invention, the insulating member 30 can be configured to directly engage the motor mount portion of the fan housing 12 without separate fasteners. In this type of arrangement, the insulating member 30 itself would act as both a fastener and an insulator between the motor casing 24 and the fan housing 12. This arrangement can be achieved through the use of a snap fit with a portion of the fan housing 12, a key fit within an aperture arrangement in the fan housing 12, or other suitable arrangement that does not require the use of a separate fastener. In one particular embodiment as shown in FIGS. 5 and 6, an insulating member 60 is provided, which includes a first base member 62 and a second base member 64 having a neck portion 66 disposed therebetween. The insulating member 60 also includes a protrusion 68 that engages the mounting aperture 40 of the motor casing 24. The neck portion 66 is configured to engage a slot 70 within a motor mount portion 72 of a fan housing and the base members 64 and 66 of the insulating member 60 cooperate to engage the motor mount portion 72. Numerous other embodiments are contemplated having the common feature of avoiding the use of separate fasteners for mounting the motor to the fan housing.

Figure 7:
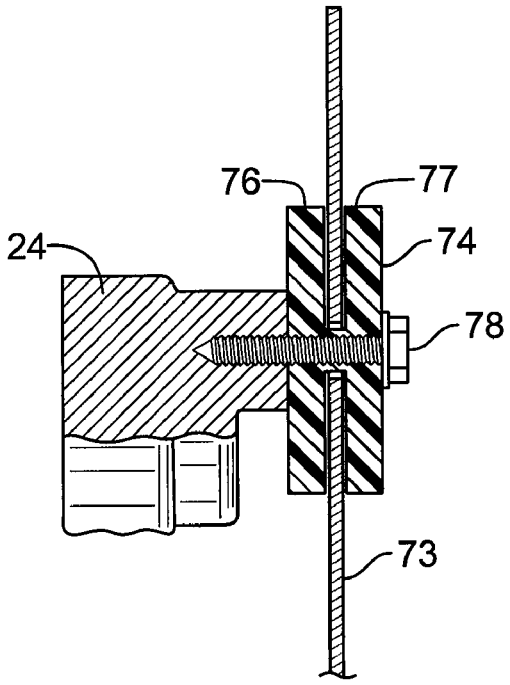
FIG. 7 is a partial cross-sectional view of a mounting area having an alternative mounting arrangement utilizing an alternative embodiment of an insulating member.

According to another aspect of the invention, insulation between the motor casing 24 and a portion of a fan housing 73 is facilitated by incorporating one or more insulating members 74 that are mounted within an aperture 75 of the portion of the fan housing 73 as shown in FIG. 7. In this embodiment, the insulating member 74 has a first portion 76—defining an insulating portion between the motor casing and the portion of the fan housing—and a second portion 77—defining an insulating portion between the portion of the fan housing 73 and a fastener 78. In such an embodiment, the fastener 78 can be allowed to penetrate the motor casing 24 while still being isolated from the fan housing 73. In a preferred embodiment according to this aspect of the invention, the insulating member 74 is a grommet or grommet-like element made of a resilient insulating material.

Figure 8:
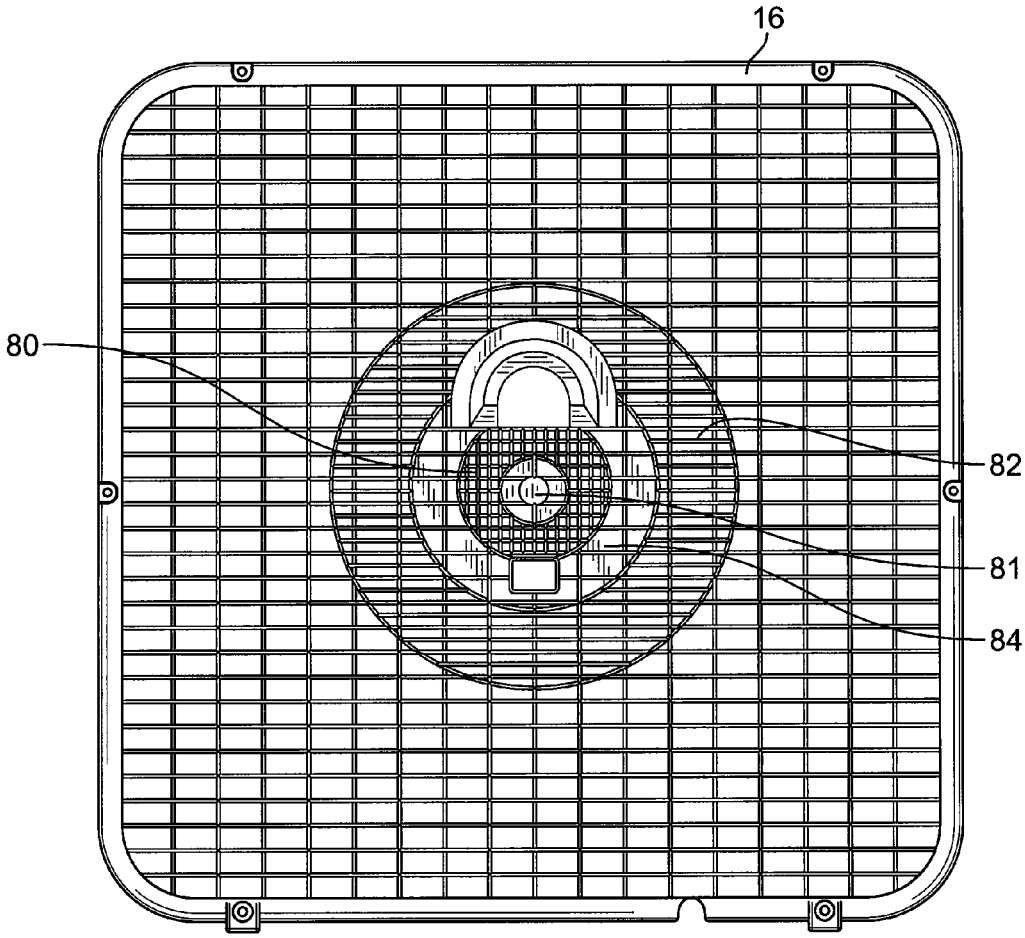
FIG. 8 is a plan view of a rear fan grill of the fan assembly shown in FIG. 1.

According to yet another aspect of the present invention, the rear grill portion 16 includes a first mesh portion 80 concentrically disposed about a centrally disposed first solid surface portion 81 and a second mesh portion 82 concentrically disposed about the first mesh portion 80, as shown in FIG. 8. A second solid surface portion 84 is disposed therebetween. The mesh portions 80 and 82 are defined by a plurality of openings within the rear grill portion 16, as best shown in FIG. 8. The first mesh portion 80 is configured to be disposed adjacent to a vented rear surface 86 of the motor casing 24 in the fan assembly, as shown in FIG. 1. The openings of the first mesh portion 80 are dimensioned such that a user's finger cannot pass therethrough and contact the motor casing 24 while still allowing sufficient air flow to cool the motor 22. The solid surface portion 84 provides an additional barrier between the mounting area and the user. The second mesh portion 82 also provides an additional barrier while still allowing air to flow therethrough. These features, alone and in combination, contribute to an insulating barrier between the motor 22 and the user.

Figure 9:
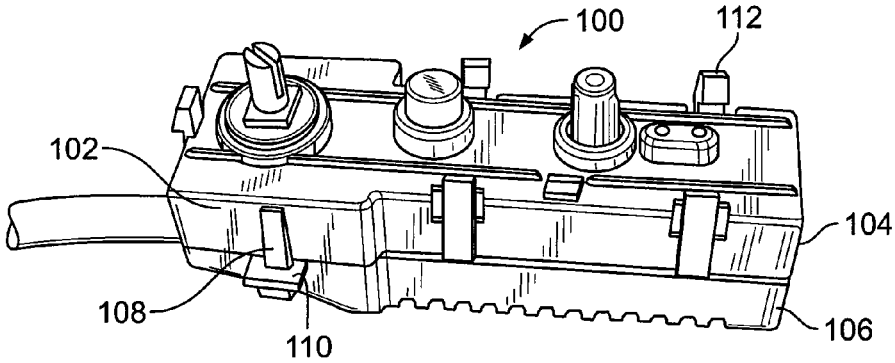
FIG. 9 is a perspective view of a control module for a fan as known in the art.
Figure 10:
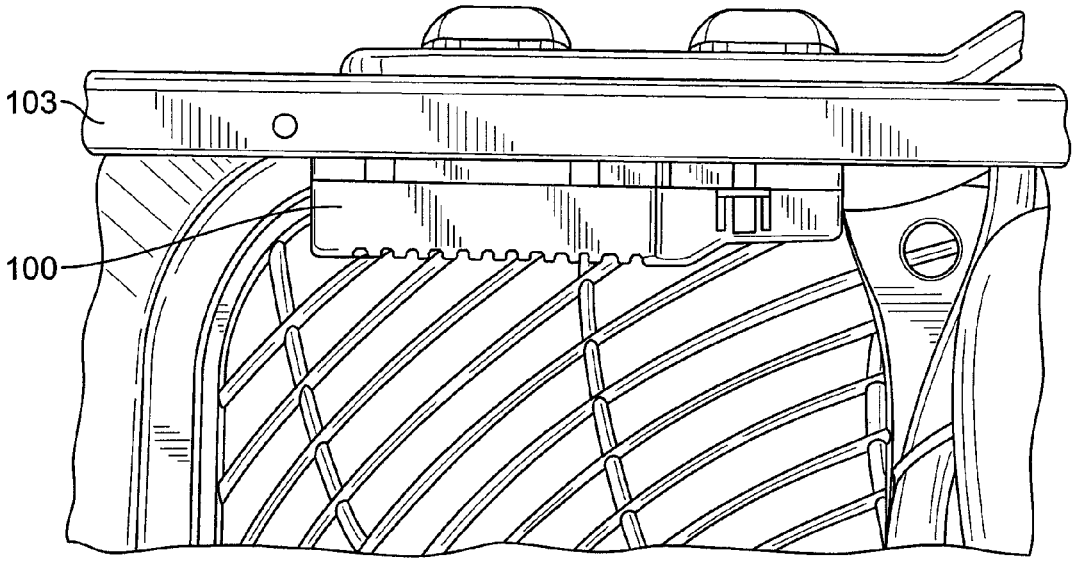
FIG. 10 is a partial elevational view of the control module of FIG. 8 shown mounted to a fan housing.
Figure 11:
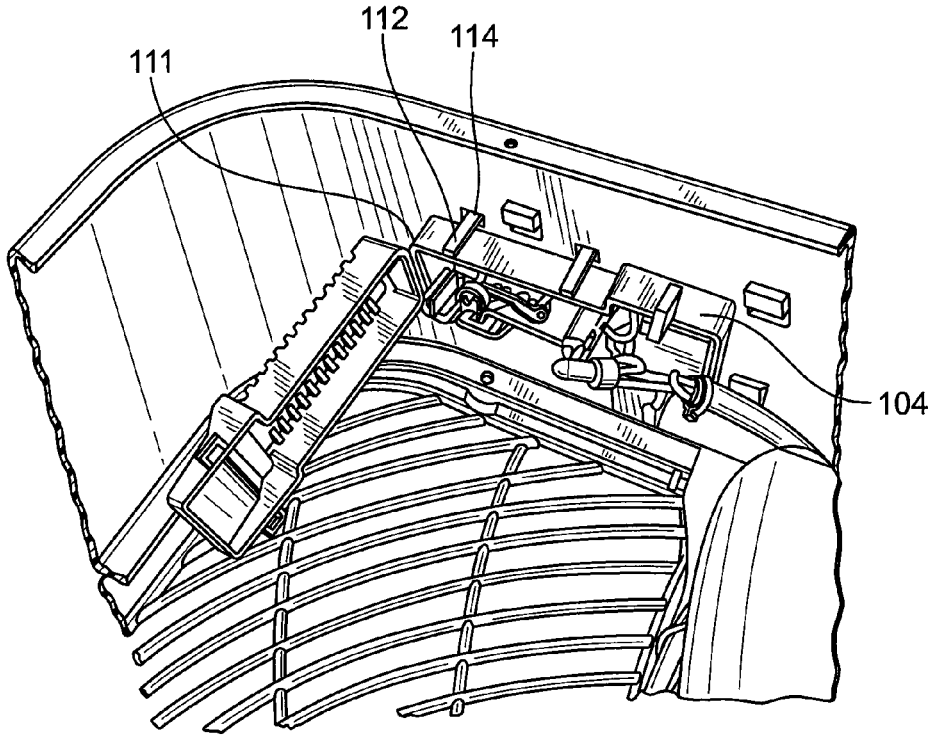
FIG. 11 is a partial perspective view of the control module shown in FIG. 9, with one case portion of a case of the module being unattached to another case portion of the case.
Figure 12:
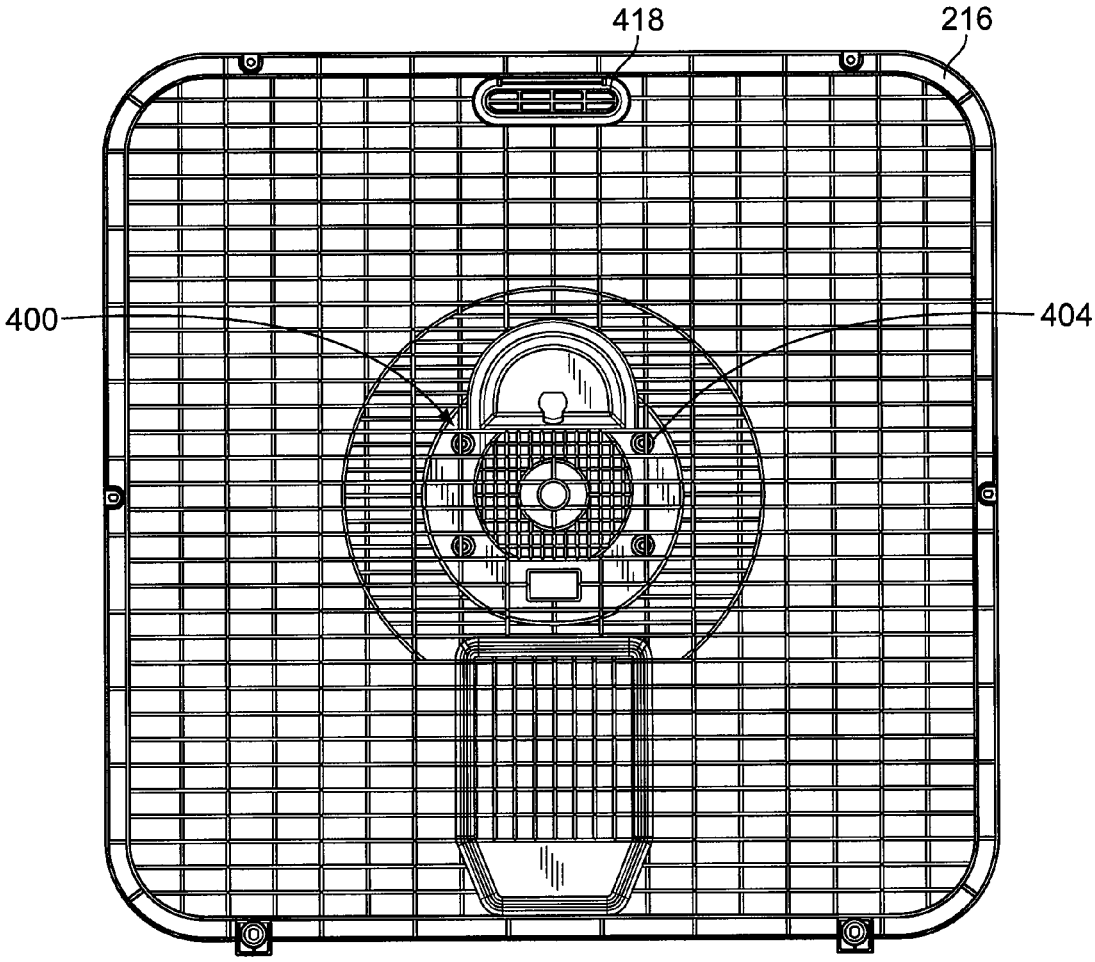
FIG. 12 is a plan view of a rear fan grill of a fan assembly according to the present invention.
Figure 13:
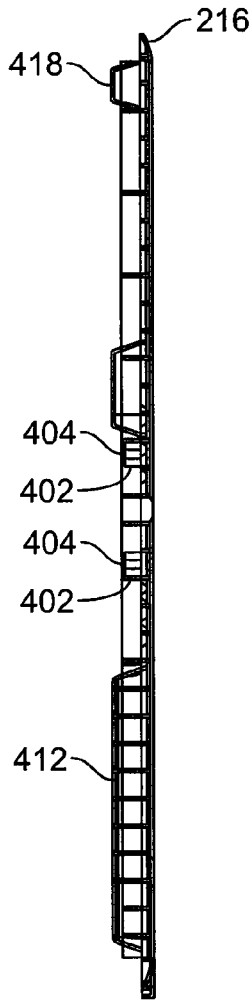
FIG. 13 is a right side view of the rear fan grill of FIG. 12.
Figure 14:
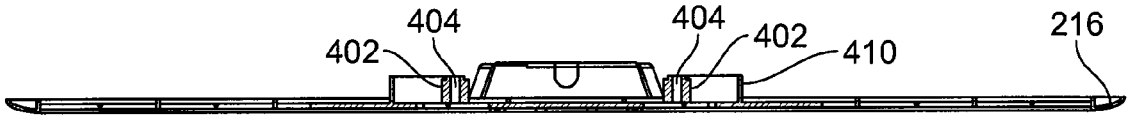
FIG. 14 is an upper horizontal cross-sectional view of the rear fan grill of FIG. 12.

In fan embodiments that do not incorporate motor assemblies having controls that are integrated into the motor casing or disposed adjacent thereto—such as, for example, the motor 22 as depicted in FIGS. 1-3, wherein the controls are isolated via the insulator members—it may be desirable to separately isolate the controls and associated electrical peripherals. Referring to FIGS. 9-11, a control module 100 having a casing 102 is depicted, wherein one or more controls and associated electrical peripherals (such as a plug receptacle, a light or LED indicator, a fuse holder, associated wiring and/or wiring connections, terminals, etc.) of the fan are isolated from surrounding components that may conduct electrical current to a user, such as a fan housing 103. In the embodiment shown, the control casing 102 includes a first casing portion 104 and a second casing portion 106. The casing portions may include attachment features in the form of one or more snap protrusions 108 and corresponding latch features 110, as shown in FIGS. 9-11, which facilitate attachment of the casing portions 104 and 106 to each other. In this particular embodiment, the casing portions 104 and 106 include a hinge 111 (shown in FIG. 11) that hingedly connects the casing portions 104 and 106 together. Preferably, the hinge is formed from a web of material that is contiguous with the casing portions 104 and 106. However, the casing portions 104 and 106 could also be completely separable. Although this is a preferable attachment arrangement, which could allow disassembly of the casing portions if desired, the casing portions could also be permanently attached to each other, such as by adhesive, weldment (such as sonic weldment), or other means. In such an embodiment, the control module 100 could be treated as a single drop-in replaceable module.

One or both of the casing portions 104 and 106 may also include an attachment feature to facilitate attachment to the fan housing 103, such as one or more snap protrusions 112, which engage the fan housing 103 via one or more corresponding snap apertures 114 within the fan housing 103. When assembled in a fan assembly, the casing 102 provides isolation of electrical componentry, which alone or in combination with other aspects of the invention described herein, contributes to providing an insulating barrier between electrical elements of the fan assembly and the user.

In another form shown in FIGS. 12-19, a fan assembly 210 according to the present invention is disclosed. In the present form, the fan motor 22 is supported by a motor support member. In a preferred embodiment, the motor support member takes the form of a rear grill portion 216. In other forms, the motor support member may take the form of nonconductive brackets or other load bearing frames, which may or may not be integrated with the rear grill portion 216. When the motor support member takes the form of a rear grill portion 216, the two vertically disposed mounting brackets 26 of the fan housing 12 (shown in FIG. 1) may be omitted. The rear grill portion 216 has a centrally disposed mounting portion 400 for attaching the motor 22 thereto. Preferably, the mounting portion 400 includes four mounting bosses 402 each having throughbores 404 for accepting fastening members, such as screws 244, shown in FIGS. 12, 13 and 17. However, the fastening members may take any other known form, such as nuts and bolts, rivets, shafts, and the like. Insulating members 30 are attached to the mounting apertures 40 of the motor mounting portion 32. The fastening members are inserted through the throughbores 404 of the mounting bosses 402 and into the insulating members 30. The screws 244 (FIG. 15) engage the insulating members 30, which in turn affix the motor 22 to the rear grill portion 216.

Figure 17:
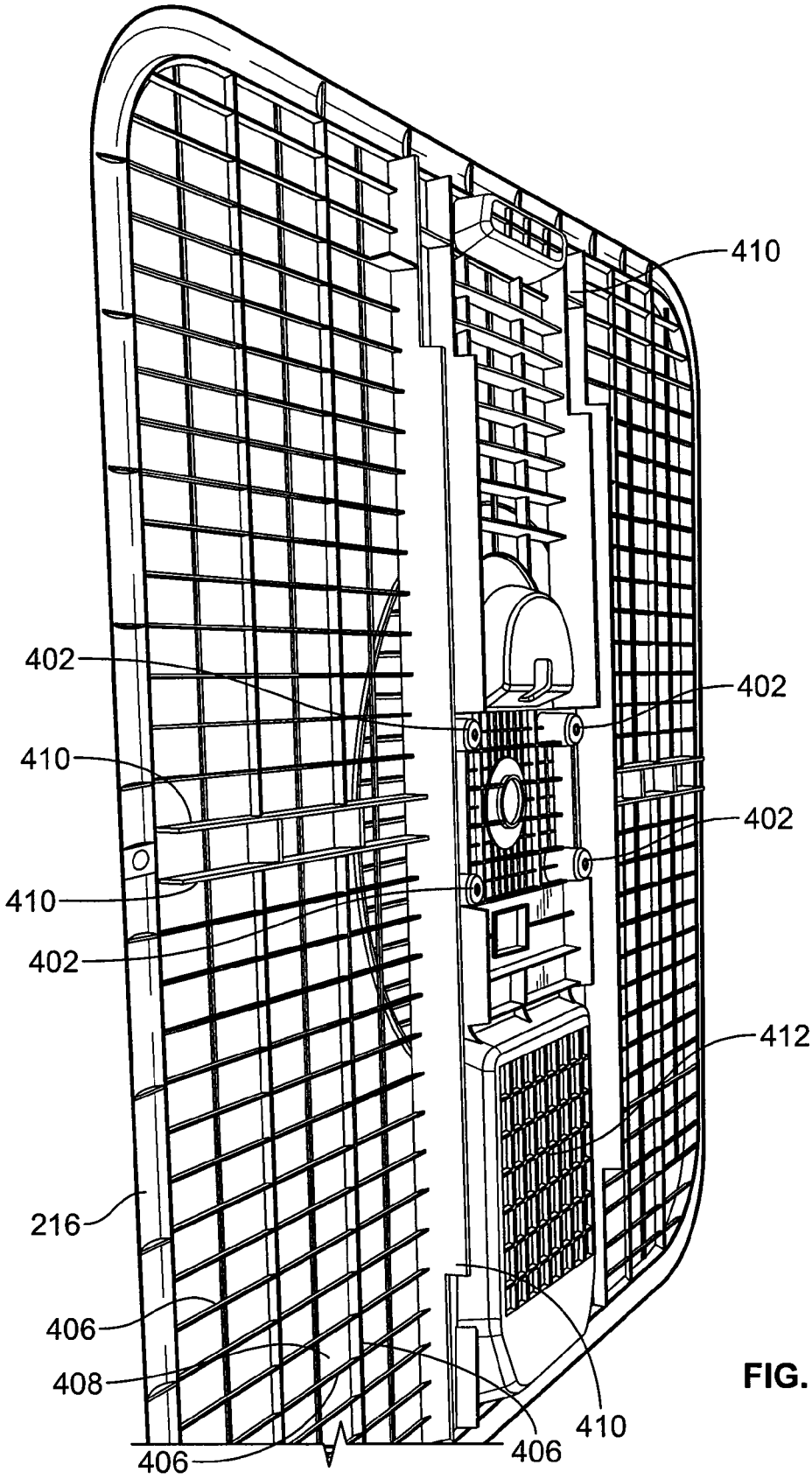
FIG. 17 is a left side perspective view of the rear fan grill of FIG. 12.
Figure 18:
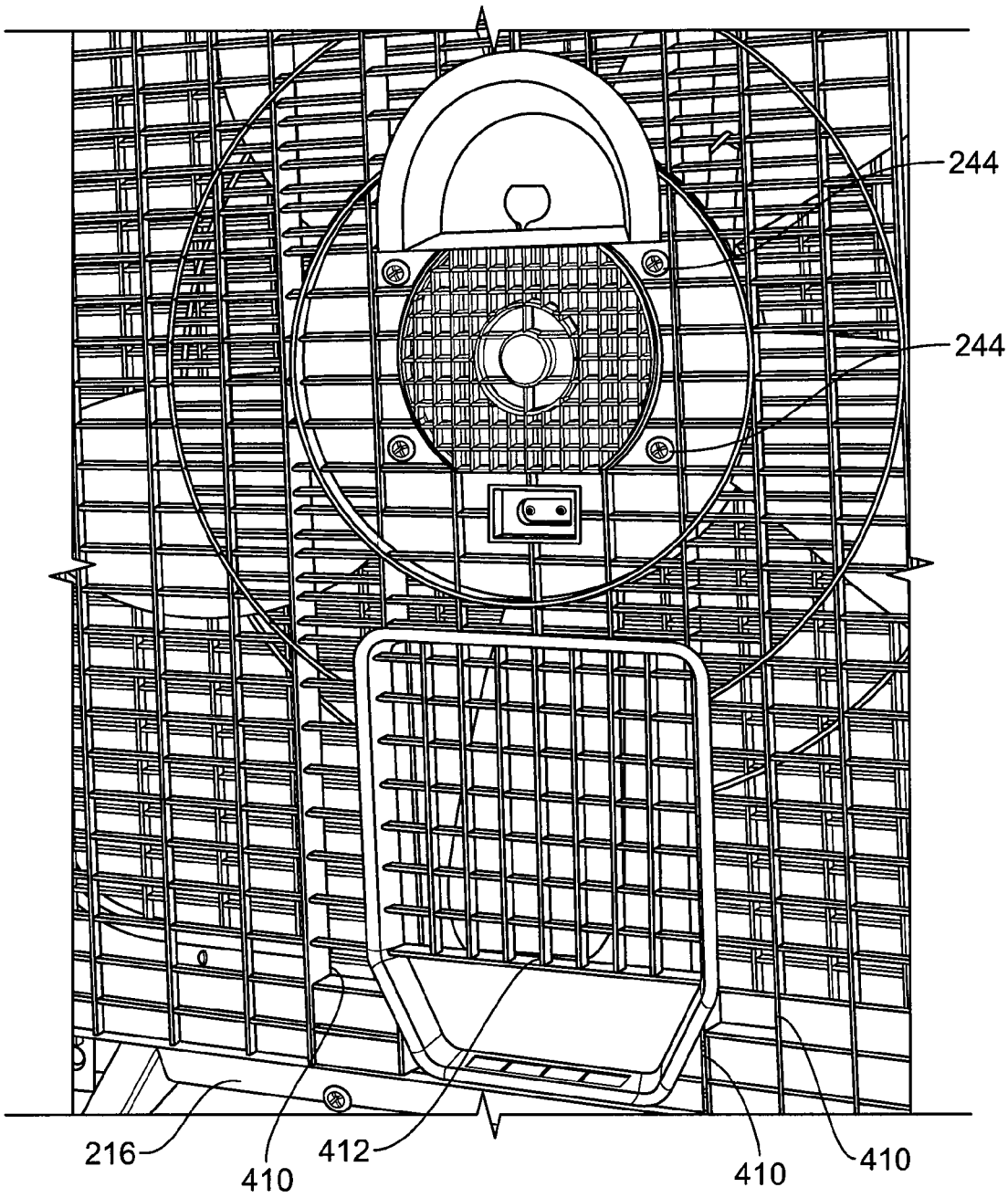
FIG. 18 is an enlarged right side perspective view of the fan assembly of FIG. 15.

As shown in FIG. 17, the rear grill portion 216 is preferably a single molded plastic piece formed with a plurality of intersecting grill members 406 forming vent portions 408 between the members. Fan grills are typically designed to maximize air flow through the grill, while being strong enough to protect the motorized blade assembly 20 from foreign objects. In the current embodiment, the grill 216 includes reinforced portions to increase the strength and stability of the grill 216 to support the weight of the motorized blade assembly 20. In particular, the grill includes enlarged grill members or braces 410 having enlarged profiles compared to the other grill members that extend along the full length of the grill 216. Preferably, the grill 216 includes both vertical and horizontal braces 410 to maximize the strength and stability of the grill 216 while minimizing the material used. In addition to the braces 410, the grill 216 also may include a reinforced portion 412 below the mounting portion 400 to increase the compressive strength of the grill 216 sufficiently to withstand the weight of the motorized blade assembly 20. In an alternate embodiment, the reinforced portions of the grill 216 may include at least one integrated bracket instead of enlarged braces 410. The integrated bracket may be used in tandem with or in place of mounting brackets 26 (FIG. 1). Preferably, the integrated bracket extends from the upper portion of the housing 12 to the lower portion of housing 12 and has an elongate form similar to the mounting brackets 26.

In another form, the motor support member may take the form of elongate mounting brackets 26. In this form, the mounting brackets 26 may be made with a non-conductive material, such as a polymer. Non-conductive plastic brackets have the advantage of increasing protection against shock and current leakage, as well as lowering the weight of the fan assembly 10, as compared with metal brackets. As shown in FIG. 4, the brackets 26 have a mounting surface 50 for mating with the motor mounting portion 32. The mounting surface 50 preferably includes a plurality of mounting apertures 416 for accepting a fastener member 44 used to connect the motor to the brackets 26. The fastener member 44 may be made of a non-conductive material, such as a polymer, thereby eliminating the need for an insulating member 30. Alternatively, the fastener member 44 may be made of a conductive material, such as metal, and used in combination with an insulating member 30 as disclosed above. When the motor support member takes the form of non-conductive mounting brackets 26, the rear grill portion 16 may be formed as shown in FIG. 1, without additional bracing or other reinforced portions. The nonconductive support bracket may take many forms other than the two separate elongate brackets 26 shown in FIG. 1. For example, a single bracket may be used that is sized and configured to have a motor mount for attaching the motor thereto.

In an alternate embodiment shown in FIG. 1, the mounting brackets 26 are made of a nonconductive material and are further insulated from the fan housing through insulating members in the form of gaskets, washers, or tabs disposed between the peripheral shroud portion 14 and the mounting brackets 26. The rear grill portion 16 may be formed with solid portions corresponding to the shape and position of the mounting brackets 26 to prevent the mounting brackets 26 from being touched by the user, thereby reducing the risk of shock or current leakage.

Figure 19:
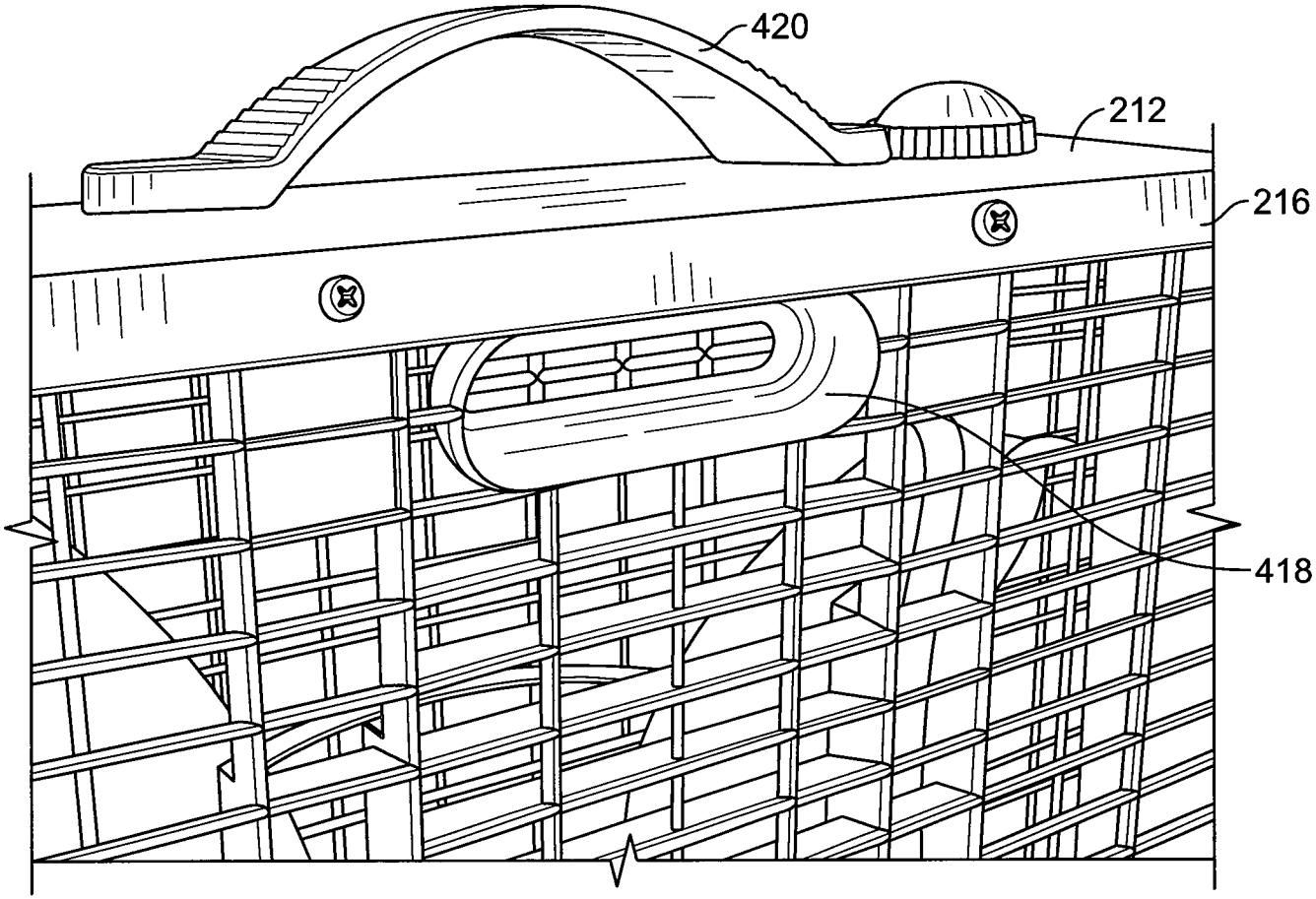
FIG. 19 is an enlarged left side perspective view of the fan assembly of FIG. 15.

In another form, the fan assembly 210 may be supplied with an integrated handle 418, as best shown in FIG. 19. The integrated handle 418 may take the form of a recessed portion disposed in the rear grill portion 216 adjacent the fan housing 212. The handle 418 is sized and configured to be easily gripped by the fingers of an adult user. The fan assembly 210 may be provided with a second handle 420 on the top of the fan housing 212 to provide a plurality of positions with which to grip the fan assembly 210. Alternatively, the second handle 420 may be omitted to simplify the design, lower unit weight, and reduce cost of materials and manufacturing.

Figure 15:
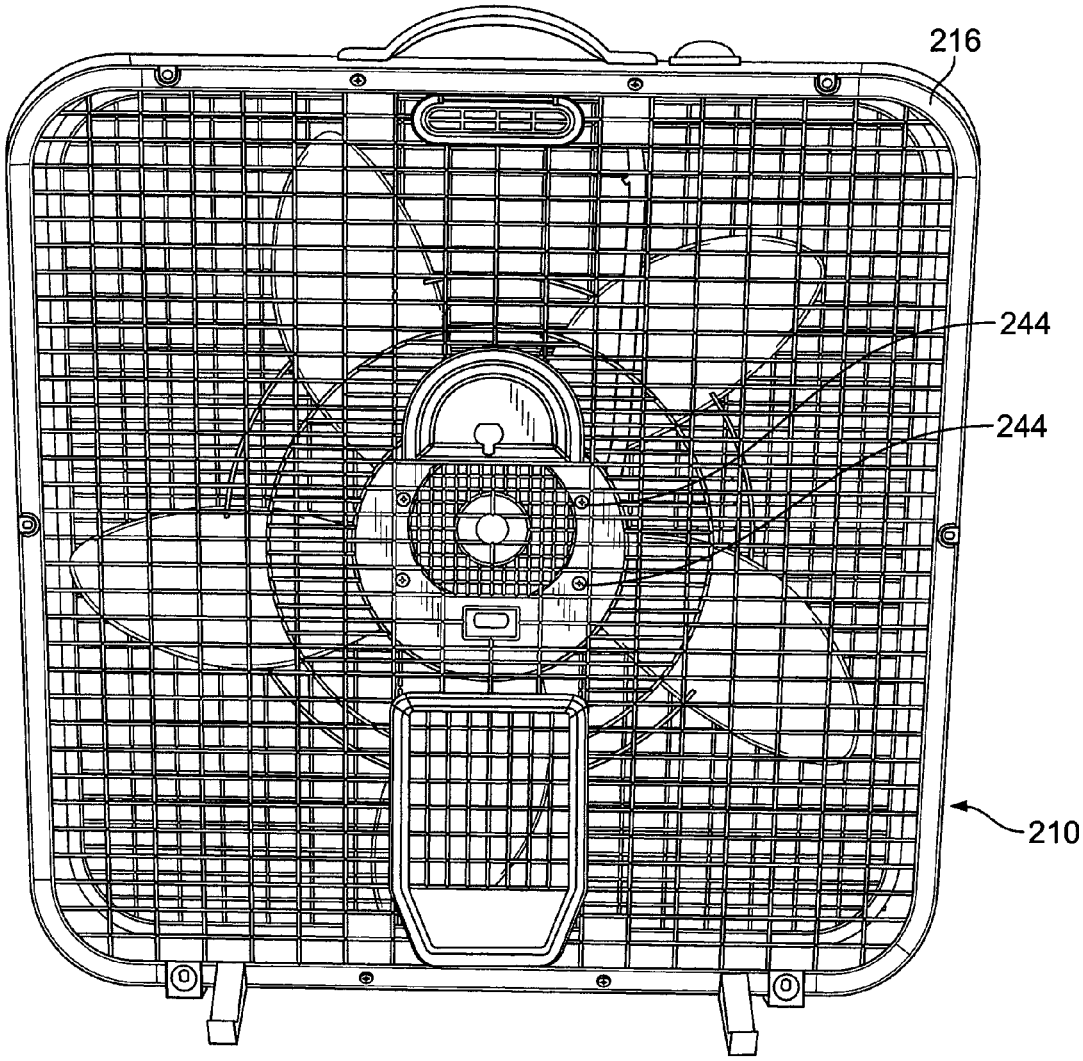
FIG. 15 is a rear view of the fan assembly according to the present invention.
Figure 16:
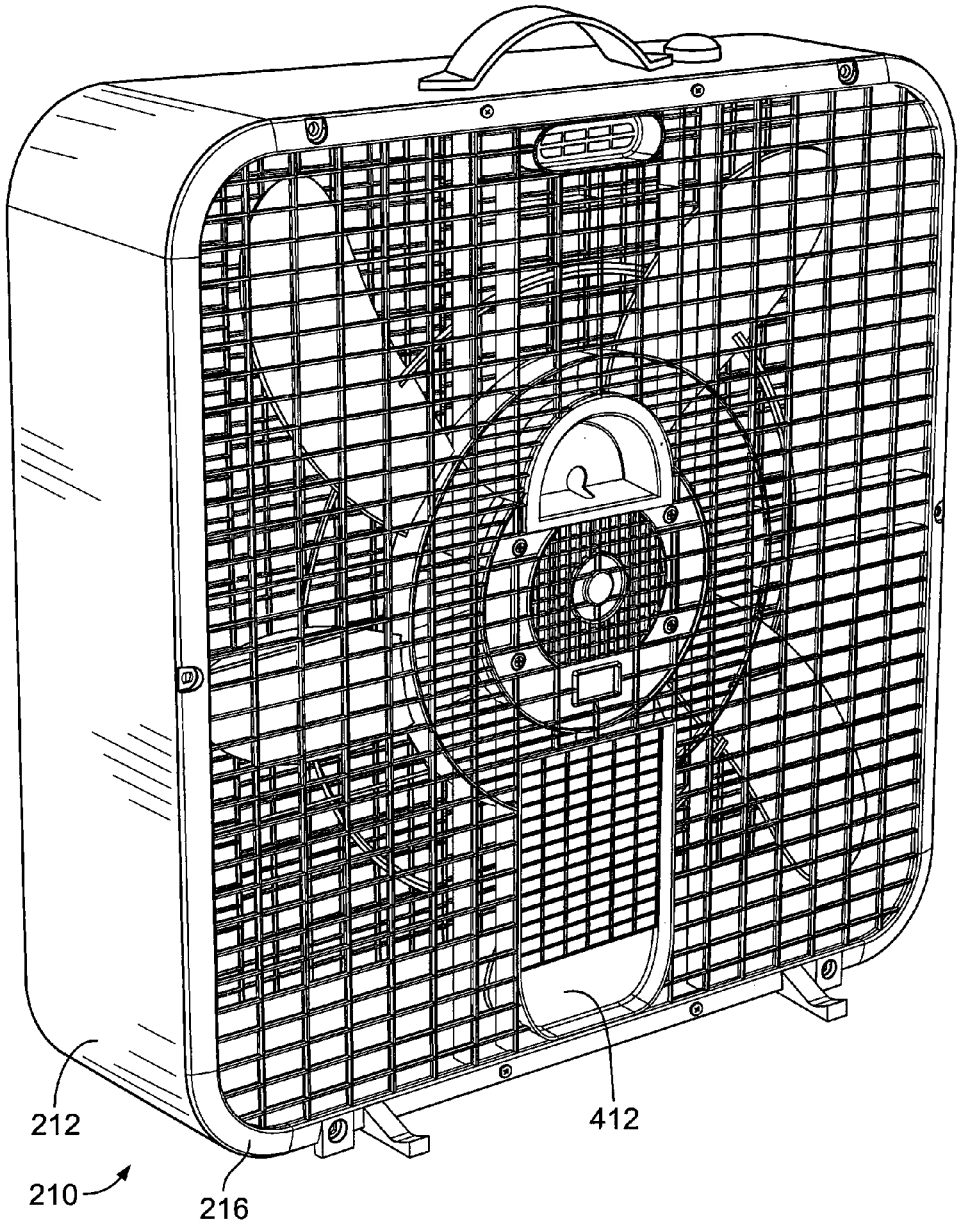
FIG. 16 is a left side perspective view of the fan assembly of FIG. 15.
Figure 20:
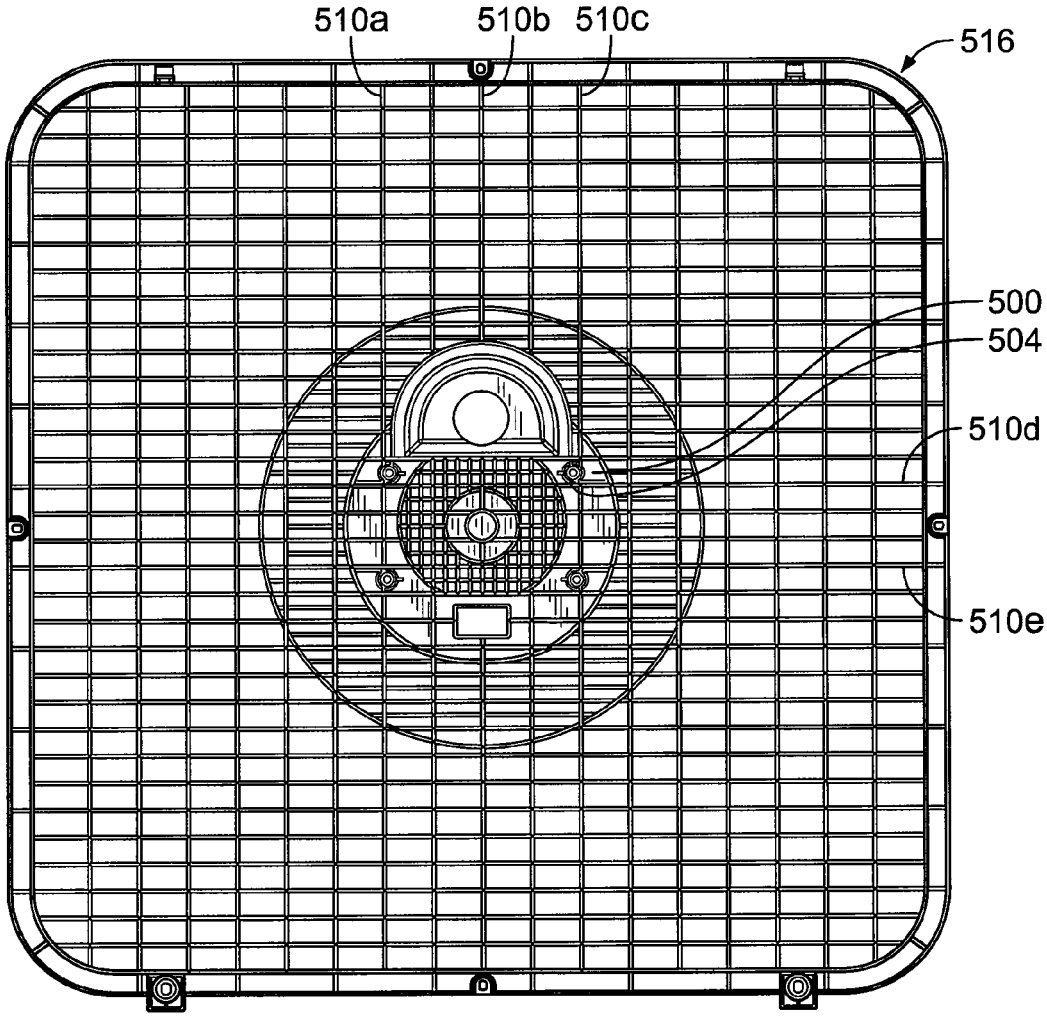
FIG. 20 is a plan view of an alternate rear fan grill of a fan assembly according to the present invention.
Figure 21:
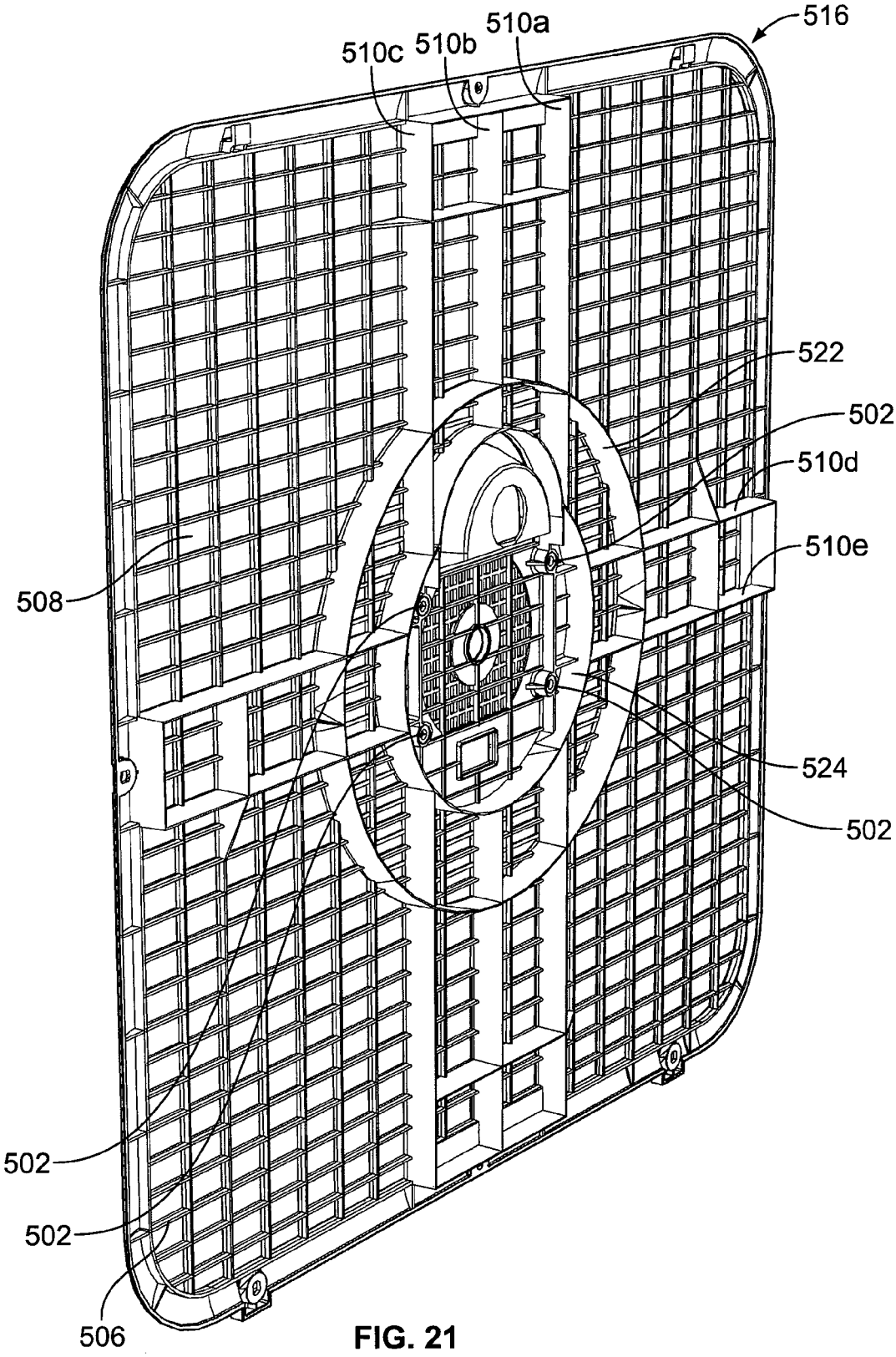
FIG. 21 is a perspective view of an interior side the rear fan grill of FIG. 20.

In another form according to the present invention, an alternate rear grill 516 for mounting a motor directly thereto without using separate motor support brackets is shown in FIGS. 20 and 21. The rear grill 516 is similar to the grill 416 of FIGS. 12-19 but for a few structural differences which will be described below. Like grill 416, rear grill 516 includes a centrally disposed mounting portion 500 for attaching the motor 22 thereto. Although not shown in FIGS. 20 and 21, the motor 22 mounts to mounting portion 500 in a similar manner as shown in FIGS. 3 and 15. The mounting portion 500 includes four mounting bosses 502 each having throughbores 504 for accepting fastening members. The motor 22 is mounted to the rear grill 516 via fastening members, e.g. screws, bolts, rivets, and the like, disposed through throughbores 504 and disposed within insulating members 30 attached to mounting apertures 40 of the motor mounting portion 32. In this manner, the rear grill 516 itself supports the motor 22 while electrically isolating the motor 22 from the shroud or housing. This configuration allows for the elimination of separate metal brackets for supporting the motor 22, which reduces material, assembly time, weight, and cost.

The rear grill 516 utilizes enlarged grill members, including vertically and horizontally disposed grill members 510*a-d* and circumferential grill members 522, 524 to increase the rigidity and strength of the rear grill 516 to enable the rear grill 516 to support the motor 22. In particular, the enlarged grill members 510*a-d* form a cross shape with the circumferential grill members 522, 524 having centers located at the center of the cross-shaped intersection of the enlarged grill members 510*a-d*, e.g., roughly at the center of the grill 516. The enlarged grill members 510*a-d*, 522, and 524 together act as an integrated load frame, which acts to remove excessive loads from the smaller grill members 506. The load frame allows the majority of the grill members 506 to have a thinner profile, which reduces weight and increases vent area. In addition, this configuration maximizes air flow through the grill because the overall vent area, e.g. the open area between the grill members, is increased by the absence of separate metal mounting brackets, which block some of the vent portions 508 when present in the fan assembly. In addition to enlarging certain grill members to increase rigidity of the rear grill 516, the intersections between all of the grill members preferably are rounded off, such that there is a radius at all four quadrants of the intersection of each horizontal and vertical grill member 506 to increase the rigidity of the grill 516.

While one or more specific embodiments have been illustrated and described, numerous modifications may come to mind without significantly departing from the spirit of the invention, and the scope of protection is only limited by the scope of the accompanying claims.

What is claimed is:

1. A fan assembly comprising:

a fan housing having a body;

grill operably connected to the fan housing and having an integrated load frame including a motor mounting portion for attaching the motor thereto, wherein the load frame includes a vertically and horizontally extending enlarged grill member having enlarged profiles for adding structural rigidity to the grill;

a motor having a plurality of mounting apertures;

a plurality of insulating members, each being disposed in one of the plurality of mounting apertures; and a plurality of fastening members, each being positioned through the motor mounting portion of the load frame and engaging one of the plurality of insulating members, such that the motor is electrically isolated from the fan housing by the insulating members.

2. The fan assembly of claim 1, wherein the fan housing includes a generally rectangular metal housing.

3. The fan assembly of claim 1, wherein the motor mounting portion of the load frame includes at least one bracket.

4. The fan assembly of claim 3, wherein the at least one bracket includes a first and second bracket extending generally parallel to one another for supporting and electrically isolating the motor.

5. The fan assembly of claim 1, wherein the load frame includes at least one enlarged grill member with an enlarged profile that extends circumferentially around a center of the grill.

6. The fan assembly of claim 1, wherein each of the plurality of insulating members is an insulating sleeve disposed on the motor.

7. The fan assembly of claim 6, wherein each of the insulating sleeve sleeves is press-fit into a portion of a housing of the motor, and one each of the plurality of fastening members is a threaded screw disposed in on each of the insulating sleeves.

8. The fan assembly of claim 2, wherein the grill has an outer face which includes an integrated handle sized and configured for providing a lift point for a user's fingers for lifting the fan assembly.

9. A generally rectangular box fan assembly comprising:

a metal fan housing having a peripheral shroud portion;

a nonconductive grill connected to the shroud portion and having an integrated load frame including a motor mounting portion for attaching the motor thereto, wherein the load frame includes a vertically and horizontally extending enlarged grill member having enlarged profiles for adding structural rigidity to the grill; and a motor assembly operably connected to the motor mounting portion of the load frame such that the motor assembly is electrically isolated from the metal fan housing and supported by the grill.

10. The box fan assembly of claim 9, further comprising an insulating member operably connected to the motor assembly and the motor mounting portion of the load frame.

11. The box fan assembly of claim 10, further comprising a fastener member connected to the insulating member for attaching the motor assembly to the motor mounting portion, such that the fastener member is electrically isolated from the motor.

12. The box fan assembly of claim 9, wherein the plurality of enlarged grill members form a cross-shape with a circumferentially disposed grill member extending about an intersection of the cross-shape formed by the enlarged grill members.

* * * * *